US009155923B2

(12) United States Patent
Proctor

(10) Patent No.: US 9,155,923 B2
(45) Date of Patent: Oct. 13, 2015

(54) PORTABLE RESPIRATORS SUITABLE FOR AGRICULTURAL WORKERS

(75) Inventor: Michele Lea Proctor, Raleigh, NC (US)

(73) Assignee: East Carolina University, Greenville, NC (US)

( * ) Notice: Subject to any disclaimer, the term of this patent is extended or adjusted under 35 U.S.C. 154(b) by 980 days.

(21) Appl. No.: 13/312,453

(22) Filed: Dec. 6, 2011

(65) Prior Publication Data

US 2013/0139816 A1 Jun. 6, 2013

(51) Int. Cl.

| | |
|---|---|
| ***A62B 18/02*** | (2006.01) |
| ***A62B 18/08*** | (2006.01) |
| *A41D 13/11* | (2006.01) |
| *A62B 18/00* | (2006.01) |

(52) U.S. Cl.

CPC ..... *A62B 18/02* (2013.01); *A41D 13/1161* (2013.01); *A41D 13/1184* (2013.01); *A62B 18/003* (2013.01); *A62B 18/08* (2013.01)

(58) Field of Classification Search

CPC ..... A62B 7/10; A62B 18/02; A62B 18/025; A62B 18/04; A62B 18/045; A62B 18/06; A62B 18/08–18/10; A62B 23/02; A62B 23/025; A61M 16/0683; A61M 16/0694

See application file for complete search history.

(56) References Cited

U.S. PATENT DOCUMENTS

| | | | | |
|---|---|---|---|---|
| 3,822,698 | A | | 7/1974 | Guy |
| 3,971,373 | A | | 7/1976 | Braun |
| 4,133,308 | A | | 1/1979 | Lowe et al. |
| 4,136,688 | A | | 1/1979 | Gorman |
| 4,157,090 | A | | 6/1979 | Phillips |
| 4,280,491 | A | | 7/1981 | Berg et al. |
| 4,462,399 | A | | 7/1984 | Braun |
| 4,674,136 | A | | 6/1987 | Ladewig |
| 4,752,974 | A | | 6/1988 | Haino |
| 4,764,990 | A | * | 8/1988 | Markert ..... 2/429 |
| 4,852,562 | A | | 8/1989 | Howie |
| 5,035,239 | A | | 7/1991 | Edwards |
| 5,054,479 | A | | 10/1991 | Yelland et al. |
| 5,104,430 | A | | 4/1992 | Her-Mou |
| 5,427,092 | A | | 6/1995 | Shiao |
| 5,533,500 | A | | 7/1996 | Her-Mou |
| 5,561,862 | A | | 10/1996 | Flores, Sr. |
| 5,577,495 | A | | 11/1996 | Murphy |
| 5,666,663 | A | * | 9/1997 | Bolle ..... 2/10 |

(Continued)

OTHER PUBLICATIONS

Proctor, Michele Lea, Farmor: A case study in design and agriculture, Thesis, Dec. 10, 2010, pp. 1-33 (of 46 total), pp. 18-22, 29-33 describe or show pictures of third party designs that existed prior to Dec. 10, 2010.

(Continued)

*Primary Examiner* — Valerie L Skorupa

(74) *Attorney, Agent, or Firm* — Myers Bigel Sibley & Sajovec, P.A.

(57) ABSTRACT

Portable personal respiratory protection devices include a self-contained head gear member with a chin collar that has a front segment that defines a mouth portion and attaches to a back segment that resides over ears of a user and extends about a lower back segment of a head of the user. The head gear includes a visually transmissive face mask extending upwardly from the front segment of the chin collar that, in position, sealably engages a face of the user. The head gear has an open upper portion residing between an outer upper perimeter of the face mask and the back segment of the chin collar that, when worn, is adapted to expose a top and upper rear portion of a head of the user to environmental conditions.

17 Claims, 7 Drawing Sheets

(56) References Cited

U.S. PATENT DOCUMENTS

| | | | | |
|---|---|---|---|---|
| 5,687,713 | A | 11/1997 | Bahr et al. | |
| D388,872 | S | 1/1998 | Grannis et al. | |
| 5,720,281 | A | 2/1998 | Allen et al. | |
| 5,758,639 | A | 6/1998 | Ikonen | |
| 5,966,746 | A | 10/1999 | Reedy et al. | |
| 6,014,971 | A | 1/2000 | Danisch et al. | |
| 6,035,451 | A | 3/2000 | Burns et al. | |
| 6,081,929 | A | 7/2000 | Rothrock et al. | |
| 6,102,033 | A | 8/2000 | Baribeau et al. | |
| 6,104,816 | A | 8/2000 | Downs, Jr. et al. | |
| 6,121,881 | A | 9/2000 | Bieback et al. | |
| 6,250,299 | B1 | 6/2001 | Danisch et al. | |
| 6,263,513 | B1 | 7/2001 | Murakami | |
| 6,279,572 | B1 | 8/2001 | Danisch et al. | |
| 6,381,749 | B1 * | 5/2002 | Cyr | 2/9 |
| 6,382,208 | B2 | 5/2002 | Reedy et al. | |
| 6,481,019 | B2 | 11/2002 | Diaz et al. | |
| 6,622,311 | B2 | 9/2003 | Diaz et al. | |
| 6,766,537 | B1 | 7/2004 | Maki et al. | |
| D503,497 | S | 3/2005 | Canavan et al. | |
| 6,886,559 | B2 * | 5/2005 | McDonald et al. | 128/201.24 |
| 6,904,616 | B1 | 6/2005 | Maki et al. | |
| 6,918,141 | B2 | 7/2005 | Green et al. | |
| 6,925,655 | B1 | 8/2005 | Maki et al. | |
| 6,942,098 | B1 | 9/2005 | Dodge | |
| 6,961,963 | B2 | 11/2005 | Rosie | |
| 6,973,677 | B2 | 12/2005 | Diaz et al. | |
| 6,990,691 | B2 | 1/2006 | Klotz et al. | |
| 7,036,502 | B2 | 5/2006 | Manne | |
| 7,055,521 | B1 | 6/2006 | Johnson | |
| 7,104,264 | B2 | 9/2006 | Lee et al. | |
| 7,114,194 | B2 | 10/2006 | English | |
| 7,197,774 | B2 | 4/2007 | Curran et al. | |
| 7,200,873 | B2 | 4/2007 | Klotz et al. | |
| 7,392,806 | B2 * | 7/2008 | Yuen et al. | 128/205.27 |
| 7,471,062 | B2 | 12/2008 | Bruning | |
| 7,523,750 | B2 | 4/2009 | Krzysztofik | |
| 7,594,510 | B2 | 9/2009 | Betz et al. | |
| D602,154 | S | 10/2009 | Ono et al. | |
| 7,616,774 | B2 | 11/2009 | Lazzeroni et al. | |
| 7,633,263 | B2 | 12/2009 | Toya | |
| 7,655,070 | B1 | 2/2010 | Dallas et al. | |
| 7,708,816 | B2 | 5/2010 | Holmes et al. | |
| 7,717,975 | B2 | 5/2010 | Kalayci et al. | |
| 7,752,682 | B2 | 7/2010 | VanDerWoude et al. | |
| 7,802,318 | B2 | 9/2010 | Chen | |
| 7,823,586 | B2 | 11/2010 | Glazman | |
| 7,878,195 | B2 | 2/2011 | Alvey et al. | |
| 7,907,975 | B2 | 3/2011 | Sakamoto et al. | |
| 7,918,913 | B2 | 4/2011 | Kalayci et al. | |
| 7,922,796 | B2 | 4/2011 | Holmes et al. | |
| 7,934,497 | B1 | 5/2011 | Grove et al. | |
| 7,937,779 | B2 | 5/2011 | Klotz et al. | |
| 7,958,573 | B2 | 6/2011 | Lewis, Jr. et al. | |
| 7,988,860 | B2 | 8/2011 | Kalayci et al. | |
| 8,011,026 | B2 | 9/2011 | Stevens | |
| D700,962 | S | 3/2014 | Lavoie | |
| D702,831 | S | 4/2014 | Lavoie | |
| D704,327 | S | 5/2014 | Lavoie | |
| D704,328 | S | 5/2014 | Lavoie | |
| D706,414 | S | 6/2014 | Lavoie | |
| 2005/0036100 | A1 * | 2/2005 | Rice et al. | 351/62 |
| 2005/0278833 | A1 | 12/2005 | Pierce | |
| 2006/0213523 | A1 | 9/2006 | VanDerWoude et al. | |
| 2008/0087282 | A1 | 4/2008 | Torgerson | |
| 2010/0069002 | A1 | 3/2010 | Rong | |
| 2010/0095439 | A1 | 4/2010 | Nolan et al. | |
| 2012/0174922 | A1 * | 7/2012 | Virr et al. | 128/203.12 |

OTHER PUBLICATIONS

3M™ Particulate Respirator; Product Information, MSC Industrial Supply Co.;1 page; Printed from Internet on May 10, 2012, but for the purpose of examination, publication date believed to be prior to Dec. 6, 2011; www.1.mscdirect.com/popupcode.html.

Fastenal®; Light Duty Dust Mask w/ Single Elastic Fixed Strap—50Ct by BodyGuard Safety Gear; © 2012 Fastenal Co.; Product Information;1page; www.Fastenal.com/web/products/detail.ex?sku=1006989.

3M™ 6000 Series Half Face Respirator with P100 Particulate Filters; Product Information, Zeflon International;1 page; Printed from internet on May 10, 2012, but for the purpose of examination; publication date believed to be prior to Dec. 6, 2011; www.zefon.com/store/3m-6000-series-half-face-respirator-with-p100-particulate-filter.

3M™ Half Facepiece Respirators 7500 Series, Ultimate Reusable; Product Information Manual; 3 pages; Issue Date Jan. 1, 2004.

3M™ 6000 Series Full Face Paint Spray Pesticide Respirator; Product Information; Enviro Safety Products; 1page; printed from internet on May 10, 2012 but for the purpose of examination, publication date believed to be prior to Dec. 6, 2011;www.enviorsafetyproducts.com/3m-6000-series-full-facepiece-paint-spray-pesticide-respirator.

3M™ RBE Loose Fitting Powered Air Purifying Respirator(PAPR) System NIOSH CBRN PAPR Approved; (models RBE-NM10, RBE-L10) Product Manual,3 pages © 2007.

3M™ Air-Mate™ Self-Contained Breathing Apparatus (SCBA), Product Information Manual; 8 pages; © 2001.

3M™ 7000 Reusable Respirators; product information;1 page; printed from the internet on May 10, 2012 but for the purpose of examination, publication date believed to be prior to Dec. 6, 2011; www.uline.com/BL_1092/3M-7000-Reusable-Respirators.

3M™ 6000 Reusable(Full Face) Respirators; product information;1 page; printed from the internet on May 10, 2012 but for the purpose of examination, publication date believed to be prior to Dec. 6, 2011,www.uline.com/BL_992/3M-6000-Reusable-Respirators.

3M™ Head Harness Replacement 6897, 3M™ Lens Assembly 6898 and 3M™ Frame Kit 6899;2 pages; Product Information; © 2007.

3M™ Versaflo™ Easy Clean PAPR Kit TR-300-ECK; Product Information; 2 pages; printed from the internet on May 10, 2012 but for the purpose of examination, publication date believed to be prior toDec. 6, 2011; http://solutions.3M.com/wps/portal/3M/en_US/PPESafetySoulutions/PPESafety/Personal.

3M™ Breathe Easy Turbo PAPR Assembly; Product Information; 47 pages; © 2009.

Trend® Airshield Air Circulating Face Shield; Product Manual; 17 pages ©Trend 2004.

Airshield Pro Complete Package; Product information;1 page; © 2004-2009; http://store.trendairshield.com/aiprounac.htm.l.

Original Airshield and Accessories; Product information;1 page; printed from the internet on May 10, 2012 but for the purpose of examination, publication date believed to be prior to Dec. 6, 2011; © 2004-2009; http://store.trendairshield.com/oraiac.html.

Lenhart, Steven W., "Respirator Selection Guidance for Poultry Growers." Poultry Grower News, Sep. 12, 1996, pp. 12-14.

Chai, Ming et al."Using an Improved Electrostatic Precipitator for Poultry Dust Removal"; Journal of Electrostatics 67.6 (2009), pp. 870-875 Science Direct. Web. Abstract Only, Apr. 2010.

Malone, George W & Ronald C. Jester. Respiratory Health on the Poultry Farm. National Ag. Safety Database, 4 pages, Jan. 2003. <http://nasdonline.org/document/197/d000146/respitory-health-on-the-poultry-farm.html>.

WSDLI, .Key Information about NIOSH Certified Respirators. Washington State Department of Labor and Industries, 4 pages, Dec. 2009., http:/www.lni.wa.gov/WISHA/Rules/respirators/PDF's/HT3-Resources.pdf.

* cited by examiner

PORTABLE RESPIRATORS SUITABLE FOR AGRICULTURAL WORKERS

FIELD OF THE INVENTION

The invention relates to respirators suitable for agricultural workers.

BACKGROUND

The poultry industry has grown significantly over the past decade. There are emerging medical studies that show the health risks and effects of confined poultry work environments on workers. Farmers and other workers with prolonged exposure, e.g., five years or more of almost daily contact, are at a greater risk for respiratory complications and disease. In addition, agricultural workers can be exposed to other occupational hazards, such as heat-related deaths. Comfort and heat issues can be significant factors that determine whether workers wear suitable protective gear or not.

There remains a need for light-weight respirators that are suitable for agricultural use and that are configured to facilitate long term, chronic use of those respirators to inhibit occupational exposure to airborne particulates.

SUMMARY OF EMBODIMENTS OF THE INVENTION

Embodiments of the present invention are directed to portable respiratory protection devices suitable for many uses, but particularly suitable for agricultural uses.

Some embodiments of the present invention are directed to portable personal respiratory protection devices. The devices include a self-contained head gear member with a chin collar that has a front segment that defines a mouth portion and attaches to a back segment that resides over ears of a user and extends about a lower back segment of a head of the user. The back segment of the chin collar includes a first locking member that is sized and configured to releasably engage a second cooperating locking member on the front segment of the chin collar for locking engagement and/or size adjustment of the chin collar. The devices also include a visually transmissive face mask extending upwardly from the front segment of the chin collar that, in position, sealably engages a face of the user. The head gear has an open upper portion residing between an outer upper perimeter of the face mask and the back segment of the chin collar that, when worn, is adapted to expose a top and upper rear portion of a head of the user to environmental conditions. The device also includes a filter chamber in the chin collar configured to releasably receive a filter for air intake and a plurality air flow ports residing across the upper portion of the perimeter of the face mask to direct cooling air into the face mask.

The face mask outer perimeter can include a curvilinear frame that rises from opposing sides of the front segment of the chin collar and terminates at an upper portion that extends above a brow line across a forehead of the user.

The device can further include an inner sealant material attached to the frame and the forward portion of the chin collar. The air flow ports can be defined in an upper portion of the inner sealant material.

The device can include a fan held in the front segment of the chin collar in fluid communication with the air flow exit ports, a wireless communication circuit held in the chin collar, and a power source held in the chin collar, the power source configured to power the fan and the wireless communication circuit.

The wireless communication circuit can include a BLUETOOTH circuit.

The chin collar can releasably hold the filter on one side of the front segment of the chin collar. The second locking member can be on an opposing side of the front segment of the chin collar.

The front section of the chin collar has a width such that a lowermost portion resides above a neck of the user proximate a chin of the user and an uppermost portion terminates proximate but under a nose of the user. The visually transmissive face mask defines a wide field of view. The back segment of the chin collar has a substantially constant width of between about 1.5-3.5 inches.

The back segment of the chin collar can include a padding layer that extends inside an outer shell of the back segment and has a width sufficient to cover a respective ear of a user. The padding is releasably engaged to the back segment of the chin collar for cleaning or replacement.

The first locking member can be a ratcheting buckle and the second cooperating member can be a receiving shaft and the device can further include a quick release button to allow the buckle to be easily disengaged by a user.

The device can include a power on/off member with an adjustable volume control residing on the back segment of the chin collar proximate an ear of the user.

The back segment can include an outer shell that resides over an inner padding layer. The back segment outer shell can include a plurality of apertures residing proximate each ear portion of the back segment to thereby allow for increased sound penetration.

The device can include a fan residing in a front medial portion of the front segment of the chin collar. The fan can be configured to generate air flow in the device of between about 5-10 cubic feet/minute.

The device can include a battery chamber in the back section of the chin collar for powering the fan.

The device can include an external power activation member residing in the back segment of the chin collar over an internal circuit board and a wirelesss communication (e.g., Bluetooth) activation member residing in the front segment of the chin collar.

The device can be in combination with a storage unit comprising a battery charging circuit.

The storage unit can be a wall-mount unit having a base that holds the respirator and recharges batteries in the back segment of the chin collar when held thereon.

The storage unit can include a visually transmissive lid that closes to enclose at least one respirator therein.

It is noted that aspects of the invention described with respect to one embodiment, may be incorporated in a different embodiment although not specifically described relative thereto. That is, all embodiments and/or features of any embodiment can be combined in any way and/or combination. Applicant reserves the right to change any originally filed claim or file any new claim accordingly, including the right to be able to amend any originally filed claim to depend from and/or incorporate any feature of any other claim although not originally claimed in that manner. These and other objects and/or aspects of the present invention are explained in detail in the specification set forth below.

DETAILED DESCRIPTION OF EMBODIMENTS OF THE INVENTION

Figure 1:
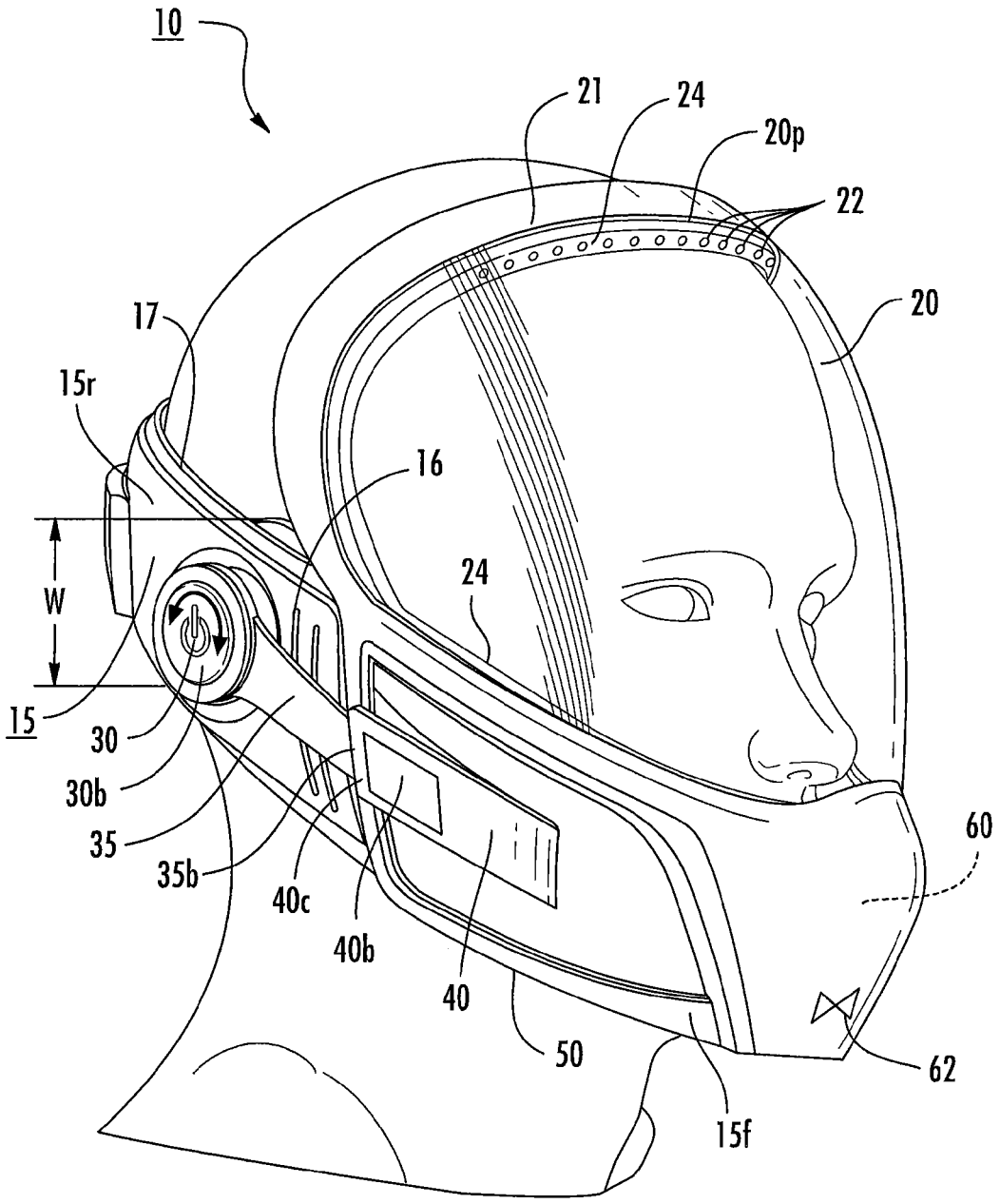
FIG. 1 is a side perspective view of a personal respirator according to embodiments of the present invention.
Figure 2:
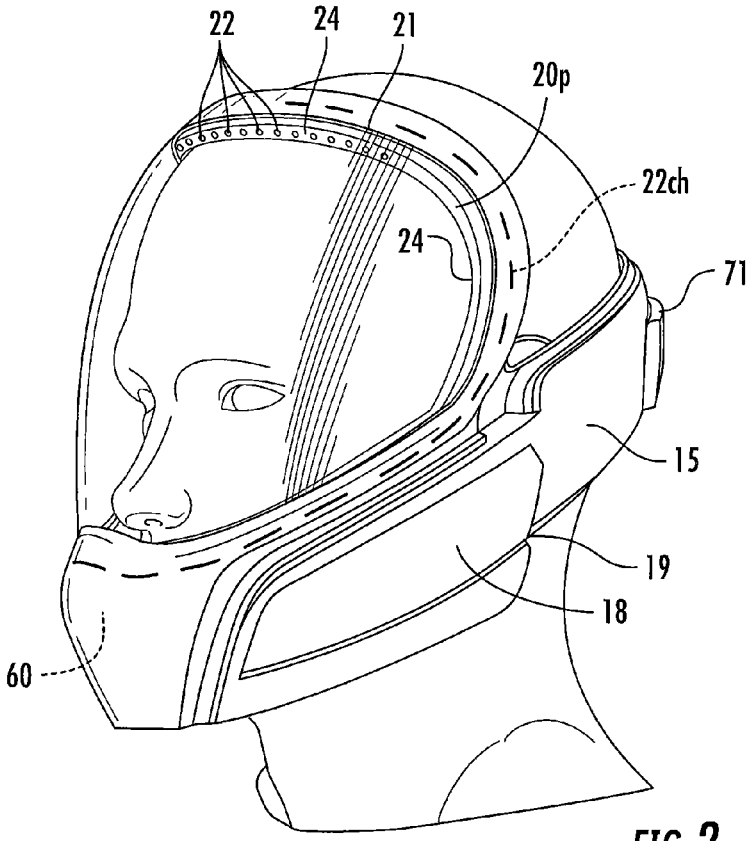
FIG. 2 is an opposing side perspective view of the device shown in FIG. 1 according to embodiments of the present invention.
Figure 3:
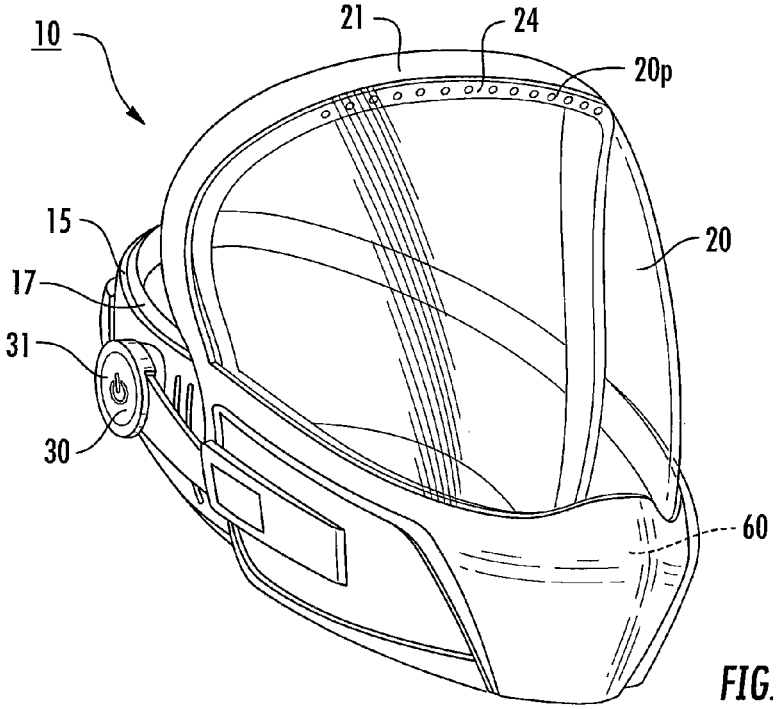
FIG. 3 is a side perspective view of the device shown in FIG. 1.
Figure 4:
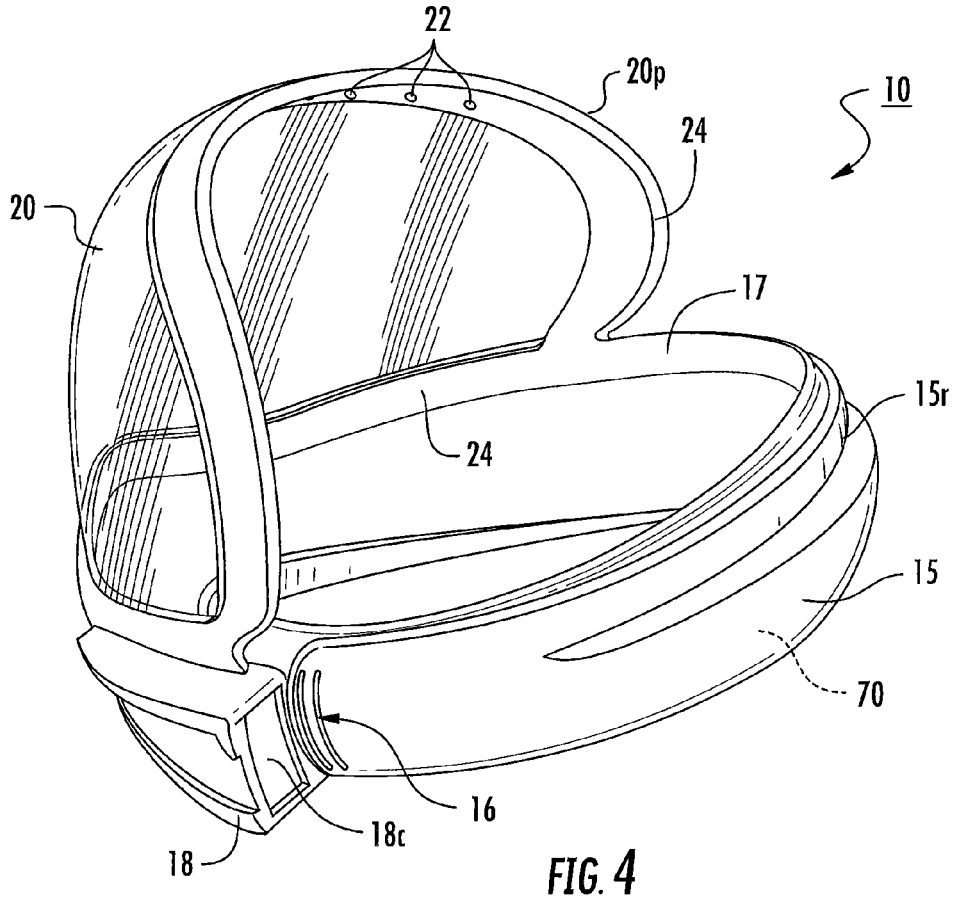
FIG. 4 is a rear side perspective view of the device shown in FIG. 1 according to embodiments of the present invention.

The present invention will now be described more fully hereinafter with reference to the accompanying figures, in which preferred embodiments of the invention are shown. This invention may, however, be embodied in many different forms and should not be construed as limited to the embodiments set forth herein.

Like numbers refer to like elements throughout. In the figures, layers, regions, or components may be exaggerated for clarity. Broken lines illustrate optional features or operations unless specified otherwise.

The terminology used herein is for the purpose of describing particular embodiments only and is not intended to be limiting of the invention. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be understood that when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention. The sequence of operations (or steps) is not limited to the order presented in the claims or figures unless specifically indicated otherwise.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

The term "chin collar" refers to a band-like member that substantially encircles the head at a location proximate the mandible.

The term "agricultural" and derivatives thereof refers to farming environments, including, for example, livestock, dairy, poultry, fish, timber and crops. Embodiments of the present invention are particularly suitable for agricultural use, including poultry confinement environments. However, other uses of the devices are contemplated, particularly where airborne contaminates or particulates or other air-quality issues may be of concern, including, for example, slaughter houses and meat or grain processing plants, oil drilling, and the like. The devices may also be suitable for other uses including medical, such as surgical, nursing or hospital uses (such as for contagious wards or rooms) and dental uses. The devices may also be suitable for research laboratory uses, research uses, police or private protection uses, for applying pesticides or fertilizers, garbage collectors, military uses, manufacturing uses, including production or devices and chemicals, paint booths, and the like, and for woodworkers and welders and the like.

FIGS. 1-8 illustrate an exemplary respirator 10. The respirator 10 can be a self-contained, head-supported (headgear) device. There is no need for any belt packs, oxygen tanks or other components. The respirator 10 can be light weight, relatively easy to put on, and can provide protection against airborne particulates. The respirator 10 includes a chin collar 15 that supports a face mask 20 (also described as a "shield"); e.g., the face mask 20 extends upwardly from the chin collar 15. The respirator face mask 20 is sealably attached to a face of a user. The mask 20 may optionally be configured to accommodate a user's eyeglasses. In some embodiments, the mask 20 can be configured to allow a customized lens portion for vision.

The respirator 10 can also include a power core 30, a cooling source such as a fan 60, an air filter 19 (FIG. 2) and have Bluetooth capability. The respirator 10 includes a head gear member that defines an open (helmetless) top that exposes the top and top rear of the head, is less-restrictive than conventional helmet-based products and may reduce heat loads induced by some conventional respirators.

The face shield 20 can be configured to provide a wide field of view (FOV) for improved visibility. The term "wide FOV" refers to a FOV that allows wider peripheral vision, typically about 180 degrees (90 degrees to each side of the head). The mask 20 can be configured to have minimal contact with a face, in that the only contact is around the outer seal in the face mask and front segment of the chin collar; there is no nose or mouth contact while providing full face protection with a wide shield for maximum visibility. The respirator 10 does not typically provide full sound protection, but is configured to provide some auditory filtering, in order to hear while using heavy equipment, but the designs also allow for additional use of ear plugs for full sound protection.

The respirator 10 can be provided as a one-size-fits-all device. More typically, the respirator 10 can be provided in an assortment of sizes, such as S, M, L, XL or other size combinations with different size shields 20 and chin collars 15.

The respirator 10 can with all operational components included (e.g., batteries, filter, fan and padding), have a weight that is under about 3.0 pounds, typically under about 2.0 pounds, and in some embodiments between about 0.75 pounds to about 1.5 pounds, such as about 1 pound.

The face mask 20 can comprise a double-paned thermal visor material, typically clear, but opaque, color, tinted or other visually transmissive materials may be used to inhibit fogging and can serve as two layers of face protection from impact. However, other transmissive materials may be used. Peel-away external film layers may also be used.

Figure 11:
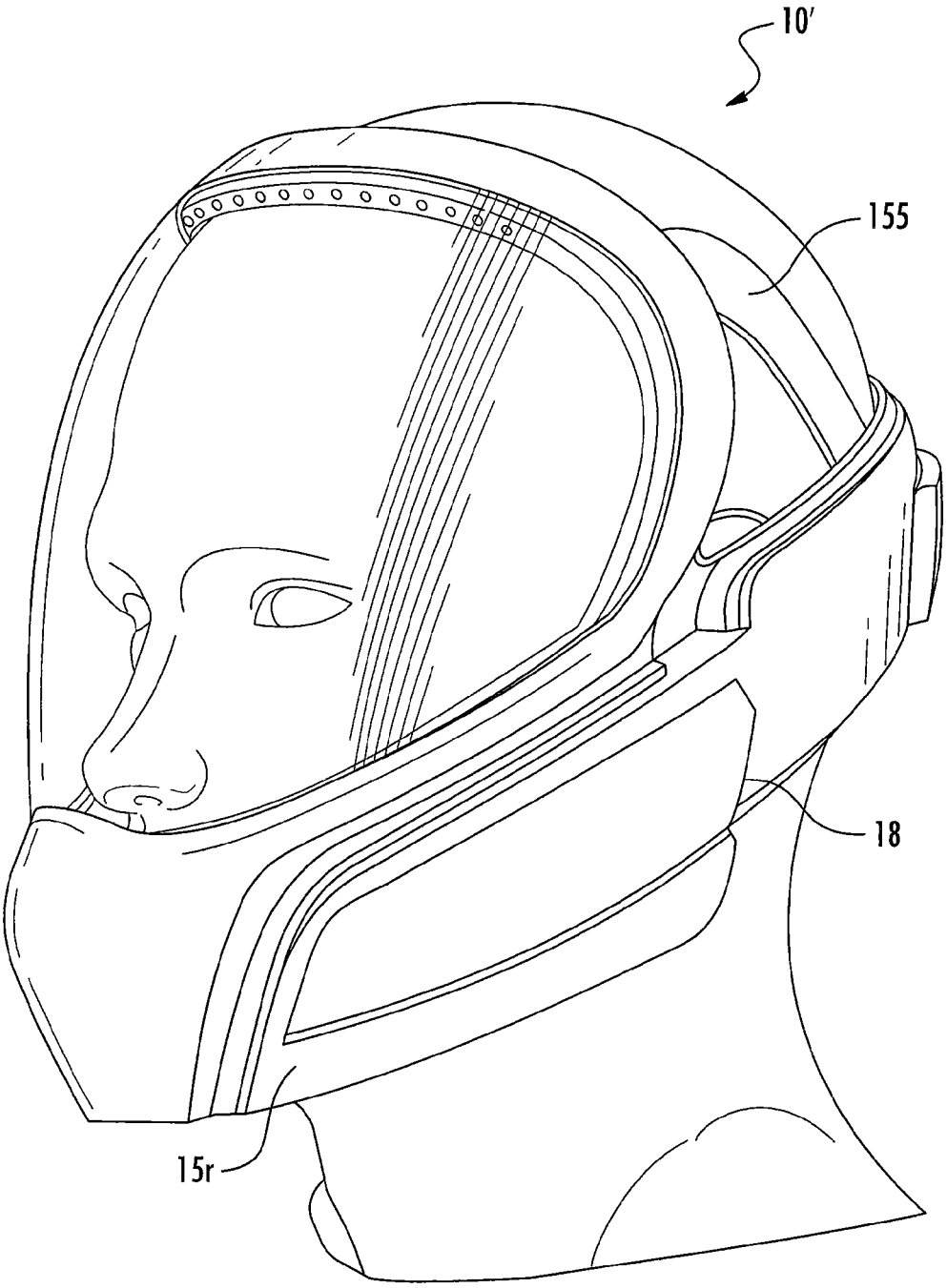
FIG. 11 is a side perspective view of another embodiment of the respirator shown in FIG. 1 according to embodiments of the present invention.

The chin collar 15 can allow for some sizing adjustment to facilitate a variety of different size users. The chin collar 15 can be configured to have a single hinge, and the respirator 20 does not require any elastic head straps to support the mask 20 which could get tangled on equipment or environmental items. FIG. 11 illustrates another embodiment of the respirator 10' which includes a supplemental support member 155. This member 155 may be elastic and/or polymeric, but does not typically extend over the top of the head of the user.

The face mask 20 can include an interior seal material 24 which is typically a conformable material that snugly abuts a face of the user and resides between the mask or shield 20 and the face of the user. The face mask 20 can sealably attach to the face of a user, e.g., via a pressure lock. Opposing pressure from either side of the face mask 20 and/or against the face of a user can click the mask tighter on the face to ensure a tight fit. The material 24 in the face mask 20 can define substantially O-shaped seal around the face which can create a double seal effect when put into compression. The O-shaped seal can extend across the upper perimeter of the frame/mask 20, down along outer side portions thereof (across the cheeks) and inside the front segment of the chin collar proximate the cheeks and above the chin, typically above the lips of the user. The material 24 can comprise silicone; the use of silicone instead of rubber increases wearer comfort and can be less rigid and inhibit face gouging.

The shield 20 has an upper perimeter 20*p* that can be encased by a frame 21. The upper portion of the visually transmissive material of the shield 20 can be sealably attached to the frame 21. The frame 21 can have a relatively short width (measured side to side on the sides or top to bottom on the top) of between about 0.25 inches to about 3 inches, typically between about 1-2 inches. Under the upper perimeter of the mask 20*p* are a plurality of spaced apart air flow outlets 22 that reside across at least a major portion of the span of the upper perimeter portion of the face mask 20. These air flow outlets 22 are in fluid communication with an active cooling source such as a fan 60 and direct cooling air into the face shield volume of the respirator 10. The air flow outlets 22 can be formed in the material 24. Fluid channels 22*ch* as internal duct work (FIG. 2, 8) can be in fluid communication with the fan 60 and extend through the chin collar 15, up the side of the face mask 20 or frame 21, then to the outlets 22 to direct a volume of cooling air into the face mask 20.

The chin collar 15 can include a front segment 15*f* that supports the shield or mask 20 and a back segment 15*r*. The back segment 15*r* can lockingly engage the front segment 15*f*. The back segment 15*r* can have a width "W" sufficient to cover substantially all of the respective ear of a user. Typically, the width W substantially corresponds to a length of the ear of a user (on average), such that typically W is between about 1.5 inches to about 3.5 inches. The width of the back segment 15*r* can be substantially constant. The chin collar 15 can comprise a semi-rigid polymeric material such as polycarbonate. Padding 17 can be provided under at least the back segment of the chin collar 15. The padding 17 can be a continuous strip of conformable material such as foam that can be washed and/or replaced when dirty. The padding 17 can also have a width that is sufficient to cover the ear of a user, and may be slightly larger or smaller than the corresponding chin collar 15*r*. The padding 17 can be releasably attached to the chin collar 15 via VELCRO, adhesive or other holding configurations.

The chin collar 15 proximate the ear of a user can include at least one slot, typically a plurality of slots 16 that provides some hearing protection while also allowing some sound to penetrate to the ears of the wearer. This can be important when a user needs to be able to hear to monitor operational equipment sounds and the like, but the ears are protected from debris and louder sounds.

The back segment 15*r* of the chin collar 15*r* be more flexible than the forward portion 15*f* by being thinner or formed of a different material than the front 15*f*. The back segment 15*r* can include an elongate strap 35 that releasably engages the front segment of the shield 15*f*. The strap 35 can comprise a ratcheting buckle 35*b* that projects forward to securely (typically lockingly) engage a channel 40*c* in the front segment of the chin collar 15. The chin collar 15 can include a release member 40*b* such as a quick-release button that allows a user to disengage the strap 35 to remove the respirator 10. While the respirator is shown as using only one locking member 35 on one side, it is contemplated that both sides of the chin collar 15 can include a locking member that releaseably engages the respective ends of the front segment 15*f*.

The respirator 10 can include a power activation button 30*b* and a wireless communication (e.g., Bluetooth®) activation device 50 that is externally accessible by a user. As shown in FIG. 1, the activation device 50 can be a push button residing on a lower edge of the chin collar 15. The wireless communication activation device 50 can be located at other positions of the respirator as well. The wireless transceiver, e.g., Bluetooth transceiver, can be held in the power core 30 or at other suitable locations. The wireless communication circuit allows a user to communicate with others without removing the respirator 10 (for example, respirator 10 to respirator 10 or via a cellular phone). The wireless communication can comprise a Bluetooth® circuit, which is an open wireless technology standard for exchanging data over short distances (using short wavelength radio transmissions in the ISM band from 2400-2480 MHz) from fixed and mobile devices. However, embodiments of the invention contemplate that the respirator 10 can include additional or alternative wireless communication circuits based on other standards or protocols to communicate with other devices. The respirator 10 can also be configured without wireless communication capability.

Figure 8:
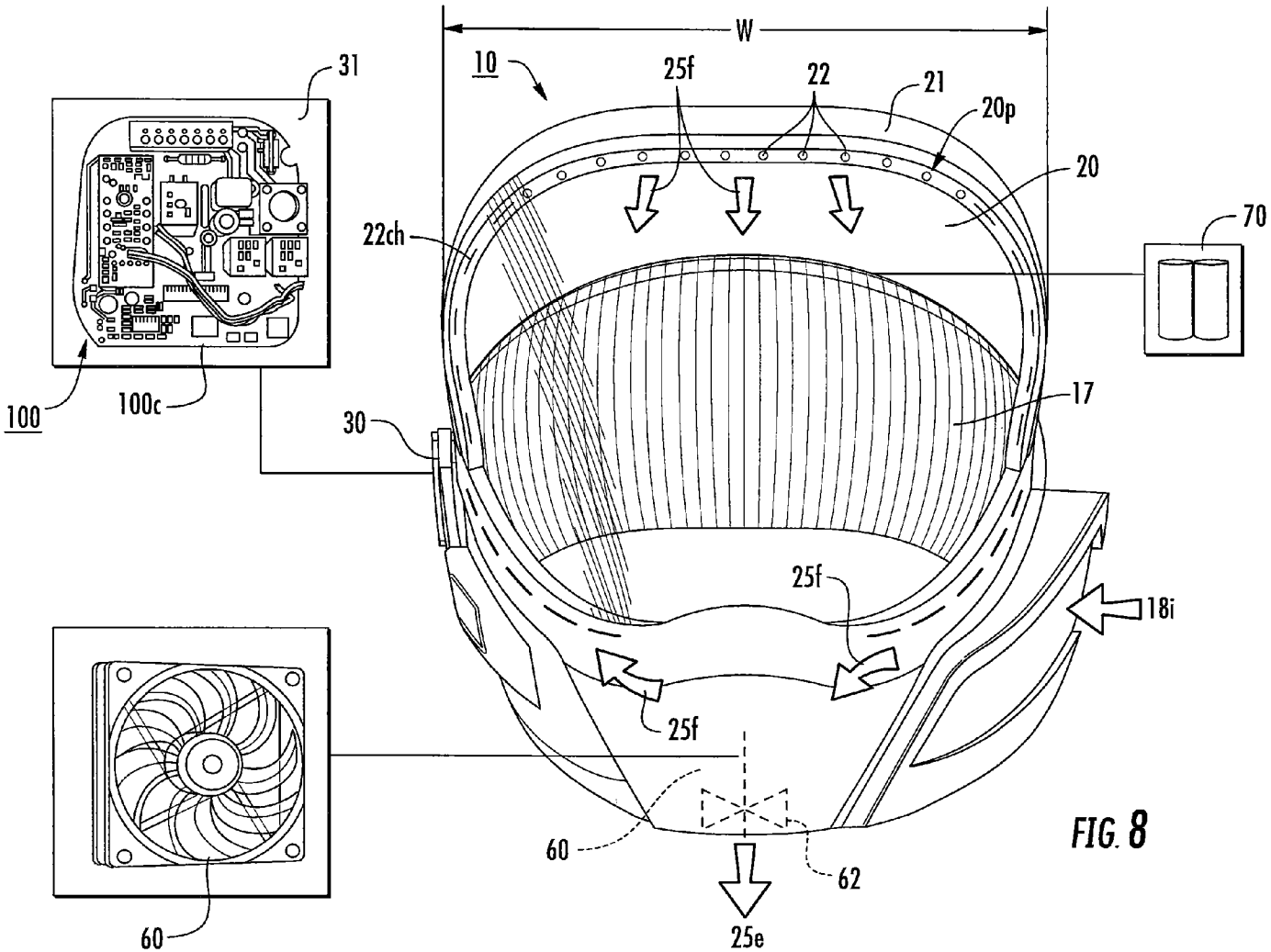
FIG. 8 is a front schematic illustration of a personal respirator with exemplary air flow circulation and circuit components according to embodiments of the present invention.

The power button 30*b* can reside over a power core 30 that holds at least part of an operational circuit 100 that includes a flex circuit or a printed circuit board 100*c* (FIG. 8). The circuit 100 can monitor for low power and include an audible alarm that sounds upon power initiation and low battery power. The button 30*b* can include an LED indicator light 31 that is on when the respirator is on. To adjust a wireless communication (e.g., Bluetooth) volume, a user can rotate the activation button 30*b*. The circuit 100 can include a motor, LED, alarms, digital signal processor, power switch and the like.

The respirator 10 also includes a cooling source 60, such as a powered-pressurized air source, typically a fan 60, residing centrally in the front or shield portion of the collar 15*f* so as to be proximate a mouth of a user. Below the fan 60, the device can include an exhaust valve 62 in fluid communication with an exit port 15*e* (FIG. 8) that vents a user's breath. The fan 60 can be a low decibel operating fan of about 35.4 dbA. However, lower or higher decibel fans can be used (with baffles or sound insulation as appropriate). The fan 60 can be a small fan. The fan 60 can have dimensions of 40 mm×40 mm×10 mm or 40×20 mm and may be a laptop fan. An example of a fan 60 is a DC axial fan, 5V 40×20 TAC OUT.

The fan 60 can be configured to move air at a rate of at least about 5 cf/m (cubic feet/minute), typically at least 8 cf/m, and more typically between about 8-12 cf/m such as about 8.8 cf/m, about 9 cf/m, about 10 cf/m. The fan can operate on any suitable voltage including between about 5V-12V. The fan 60 can have a use life of 16 hours using on-board rechargeable batteries 70. The respirator 10 can allow a user to adjust the fan speed/air flow or the respirator can self-adjusted based on an electronically monitored temperature inside or outside the head gear.

The respirator 10 can have a battery pack 70 that includes a plurality of battery cells or batteries that provide sufficient power, typically at least about 1000 mA/h, typically about 2000 mA/h. The battery pack 70 can be held in a battery chamber 71 (FIG. 2) on the back of the back segment of the chin collar 15. However, the battery pack 70 can be distributed or held in another location. The battery pack 70 can include a plurality of 3.2V LiFEpO4 rechargeable cells. These batteries contain no heavy metals, and are smaller and lighter weight than traditional NiCa or Lithium Ion batteries. However, other batteries can be used, rechargeable or not. Different batteries can be used to power different components or a single battery supply can power all on-board components.

Figure 5:
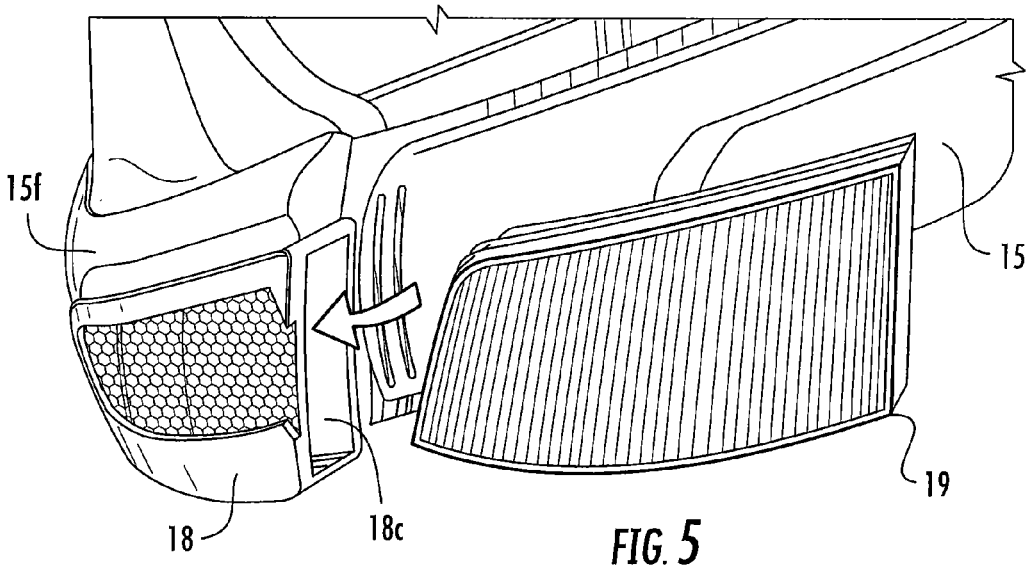
FIG. 5 is an enlarged side perspective view of the device shown in FIG. 4 according to embodiments of the present invention.
Figure 6:
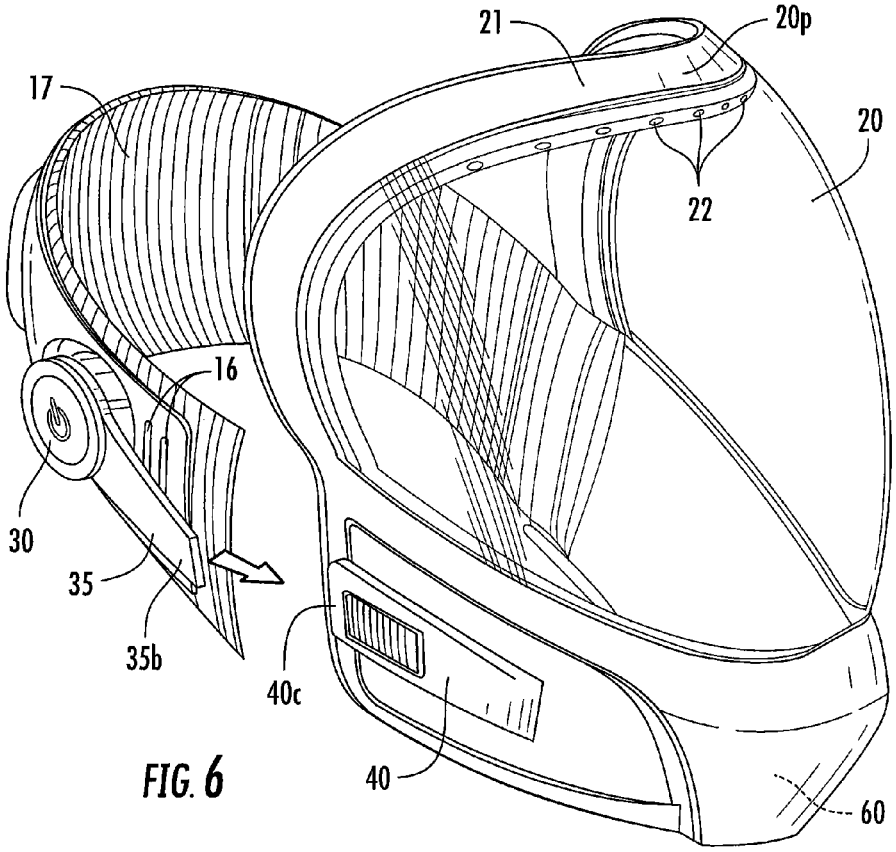
FIG. 6 is a front, side perspective view of the device shown in FIG. 1 illustrating a locking engagement of two cooperating members according to embodiments of the present invention.
Figure 7:
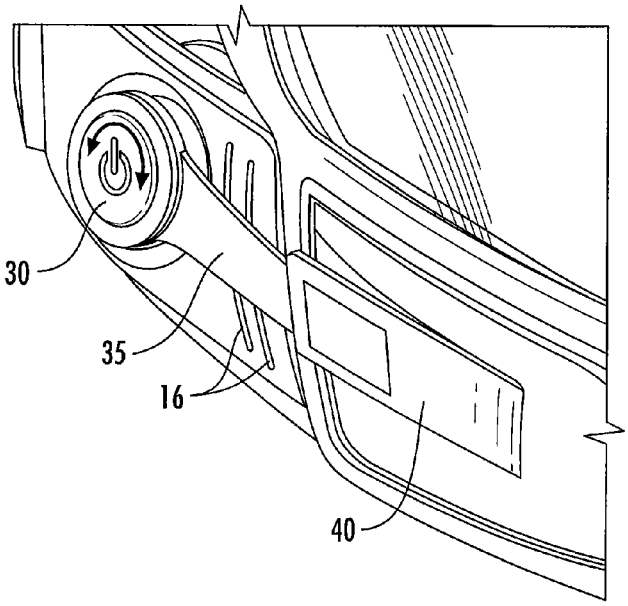
FIG. 7 is a partial side perspective view of the device shown in FIG. 6 with the two locking members engaged according to embodiments of the present invention.

FIG. 5 illustrates that the front of the face shield at the chin collar 15*f* can include a filter chamber 18*c* that slidably receives filter cartridges 19. The filter 19 can have a flexible plastic perimeter rim to inhibit solid waste (most of the filter can be biodegradable). While it is shown as including a single filter chamber 18*c*, on one side of the font portion of the chin collar, multiple filters may be used at any suitable location or locations or the single filter can be provided at a different location.

FIG. 8 illustrates that air is pulled in through air inlets 18*i* into filter 19, then internal air flow 25*f* is directed through ducting 22*ch* around the perimeter of the shield 20 to exit through air flow ports 22 at the top of the shield 20. Exhaled air 25*e* can be directed down and away from the face of a user, out from the mask 20 using an exhalation valve 62, such as a COOL FLOW™ exhalation valve from 3M Corporation.

To promote hygiene or inhibit multiple users from sharing a respirator 10, the device 10 can include a password, biometric recognition input, physical lock and key arrangement or other lock that inhibits activation by an unauthorized user.

Figure 9:
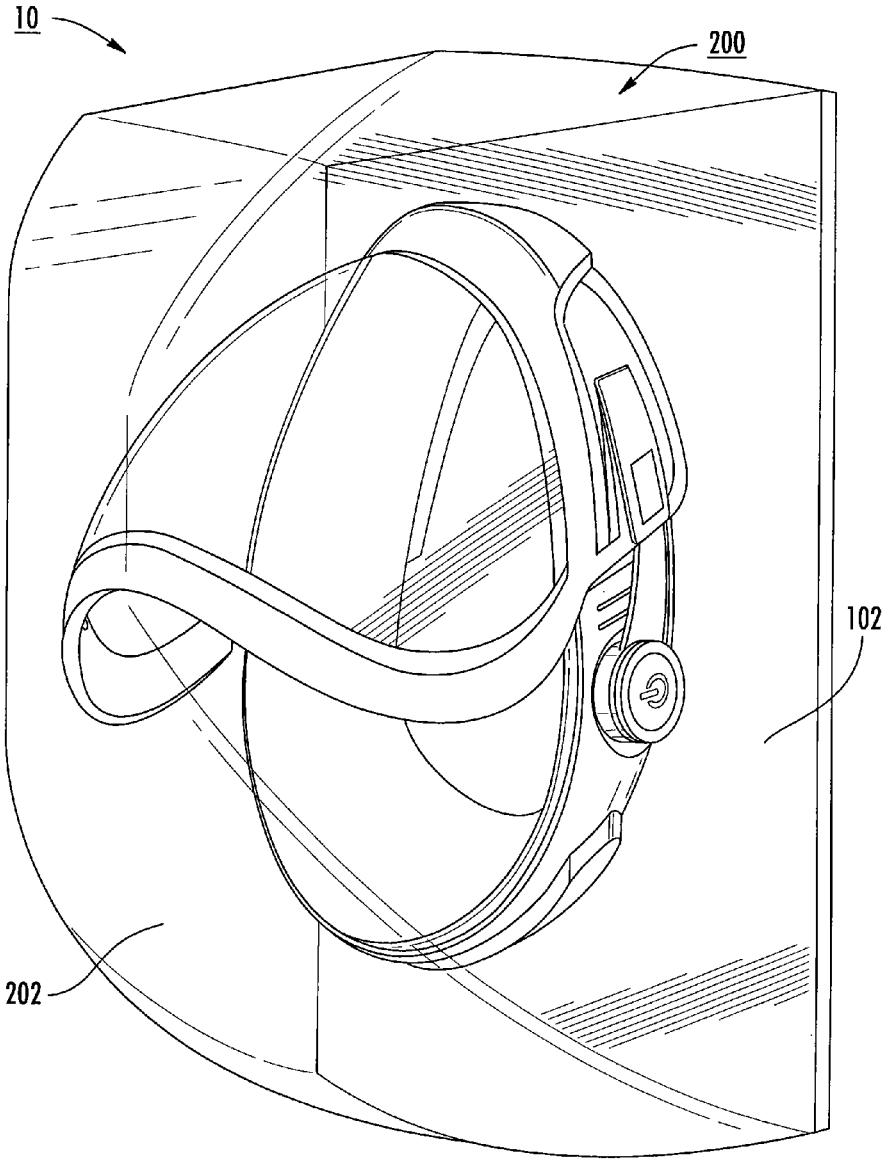
FIG. 9 is a front, side perspective view of a personal respirator in a storage unit according to embodiments of the present invention.
Figure 10:
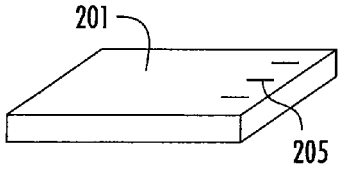
FIG. 10 is a side schematic illustration of a base suitable for holding a respirator for recharging batteries according to embodiments of the present invention.

FIG. 9 illustrates a storage unit 200 for the respirator 10. The storage units can be individually sized to hold single ones of the respirators 10 or a plurality of the respirators 10. The storage units 200 can include a base 201 that includes a recharging circuit 202 for the rechargeable batteries 70. The storage units 200 can be configured as a wall-mounted storage unit. For example, a station of storage units (or one storage unit that holds multiple respirators) can be mounted to a wall of a poultry computer control room for ease of access and storage. The storage unit can include an acrylic or other material cover 202. The base 201 can be configured with a wireless recharging circuit 205 that recharges the batteries. FIG. 10 illustrates that the base 201 can include exposed terminals 205*t* that connect with terminals on the respirator for charging the on-board batteries 70. However, a charging cord may also be used to provide the connection for charging the respirator 10. The storage unit 200 can provide a sealed protective box/container with a hanger that may preserve or prolong the life of the filter 19 and/or inhibit the respirator from contamination or dirt exposure during periods of non-use. The respirator 10 can be locked to the base or the sealed cover can be locked to inhibit unauthorized use.

The respirator 10 can include a compliance monitoring module that monitors the dates of activation/use. This module can be partially or totally "on-board" the respirator or can reside partially or totally in a control or monitoring station. The control station can be in wireless communication with a plurality of respirators to monitor for dates/times of activation and the monitoring module can send an alert when it is determined that a user is not in compliance with defined norms, e.g., at least 4 hours of each workday or when the respirator is not activated for at least a certain number of hours over a work week. The monitoring can be triggered based on when a worker "clocks in" or otherwise correlated to a work schedule. On-board sensors can be used to monitor if the respirator 10 is actually used versus just "turned on" and set aside, including moisture or temperature monitors, air flow (particularly for exhaust air flow, such as through an exhaust valve). The circuit 100 can include a clock, timer and/or other monitoring input accessible by a remote processor. In some embodiments, the monitoring can be based on data from the storage unit, e.g., when it is in the storage unit when a worker is onsite. Thus embodiments of the invention propose methods of monitoring for compliance with safety standards.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. In the claims, means-plus-function clauses, where used, are intended to cover the structures described herein as performing the recited function and not only structural equivalents but also equivalent structures. Therefore, it is to be understood that the foregoing is illustrative of the present invention and is not to be construed as limited to the specific embodiments disclosed, and that modifications to the disclosed embodiments, as well as other embodiments, are intended to be included within the scope of the appended claims. The invention is defined by the following claims, with equivalents of the claims to be included therein.

That which is claimed is:

1. A portable personal respiratory protection device, comprising:

a self-contained head gear member comprising a chin collar that has a front segment that defines a mouth portion and attaches to a back segment that is adapted to reside over ears of a user and extend about a lower back segment of a head of the user, wherein the back segment of the chin collar comprises a first locking member that is sized and configured to releasably engage a second cooperating locking member on the front segment of the chin collar for locking engagement and/or size adjustment of the chin collar;

a visually transmissive face mask extending upwardly from the front segment of the chin collar that, in position, is adapted to sealably engage a face of the user, the face mask having an outer perimeter with two opposing side portions and an uppermost portion extending between the two side portions, wherein the head gear member has an open upper portion residing between the uppermost portion of the face mask and the back segment of the chin collar that, when worn, is adapted to expose a top and upper rear portion of a head of the user to environmental conditions;

a filter chamber in the chin collar configured to releasably receive a filter for air intake; and a plurality of air flow ports residing across the upper portion of the perimeter of the face mask to direct cooling air into the face mask.

2. The device of claim 1, wherein the face mask outer perimeter comprises a curvilinear frame that rises from opposing sides of the front segment of the chin collar and defines the uppermost portion of the face mask to terminate above a brow line and across a forehead of the user.

3. The device of claim 2, further comprising an inner sealant material attached to the frame and the front segment of the chin collar, wherein the air flow ports are defined in an upper portion of the inner sealant material.

4. The device of claim 1, further comprising a fan held in the front segment of the chin collar in fluid communication with the air flow ports, a wireless communication circuit held in the chin collar, and a power source held in the chin collar, the power source configured to power the fan and wireless communication circuit.

5. The device of claim 4, wherein the wireless communication circuit comprises a short wavelength radio transmission circuit.

6. The device of claim 1, wherein the chin collar releasably holds the filter on one side of the front segment of the chin collar, and wherein the second locking member is on an opposing side of the front segment of the chin collar.

7. The device of claim 1, wherein the front segment of the chin collar has a width sufficient so that a lowermost portion is adapted to reside above a neck of the user proximate a chin of the user and an uppermost portion is adapted to terminate proximate but under a nose of the user, and wherein the visually transmissive face mask defines a wide field of view, and wherein the back segment of the chin collar has a substantially constant width of between about 1.5-3.5 inches.

8. The device of claim 1, wherein the back segment of the chin collar comprises a padding layer that extends inside an outer shell of the back segment and has a width sufficient to cover a respective ear of a user, and wherein the padding is releasably engaged to the back segment of the chin collar for cleaning or replacement.

9. The device of claim 1, wherein the first locking member is a ratcheting buckle and the second cooperating locking member is a receiving shaft, wherein the device further includes a quick release button to allow the buckle to be easily disengaged by a user.

10. The device of claim 1, further comprising a power on/off member with an adjustable volume control residing on the back segment of the chin collar proximate an ear of the user.

11. The device of claim 1, wherein the back segment comprises an outer shell that resides over an inner padding layer and right and left ear portions, and wherein the back segment outer shell comprises a plurality of apertures residing proximate each ear portion of the back segment to thereby allow for increased sound penetration.

12. The device of claim 1, further comprising a fan residing in a front medial portion of the front segment of the chin collar, wherein the fan is configured to generate air flow in the device of between about 6-10 cubic feet/minute.

13. The device of claim 12, further comprising a battery chamber in the back segment of the chin collar for powering the fan.

14. The device of claim 1, further comprising an external power activation member residing in the back segment of the chin collar over an internal circuit board and a wireless communication activation member residing in the front segment of the chin collar.

15. The device of claim 1, in combination with a storage unit comprising a battery charging circuit.

16. The device of claim 15, wherein the storage unit is a wall-mount unit having a base that holds the personal respiratory protection device and recharges batteries in the back segment of the chin collar when held thereon.

17. The device of claim 15, wherein the storage unit further comprises a visually transmissive lid that closes against a base to enclose at least one personal respiratory protection device therein.

* * * * *